US005092682A

United States Patent [19]

Fenick

[11] Patent Number: 5,092,682

[45] Date of Patent: Mar. 3, 1992

[54] TRANSPORTABLE SHOWER BAG

[76] Inventor: Paul T. Fenick, 152 Whisconier Rd., Brookfield, Conn. 06804

[21] Appl. No.: 642,876

[22] Filed: Jan. 18, 1991

[51] Int. Cl.[5] ..... B65D 30/06; B65D 33/14; B65D 33/16

[52] U.S. Cl. ..... 383/22; 383/97; 383/102; 383/117

[58] Field of Search ..... 383/11, 22, 23, 24, 383/97, 102, 117

[56] References Cited

U.S. PATENT DOCUMENTS

| | | | |
|---|---|---|---|
| 1,749,776 | 3/1930 | O'Lena | 383/117 |
| 2,457,918 | 1/1949 | Pierce | 383/11 |
| 2,511,644 | 6/1950 | Liss | 383/102 |
| 2,804,898 | 9/1957 | Cox | 383/97 |
| 3,074,452 | 1/1963 | Bridges | 383/23 |
| 3,231,901 | 2/1966 | Kennedy | 383/23 |
| 3,377,121 | 4/1968 | Billesbach et al. | 383/24 |
| 4,228,834 | 10/1980 | Desnick | 150/3 |
| 4,388,739 | 6/1983 | Martinon et al. | 8/150 |
| 4,967,986 | 11/1990 | Schildkraut | 383/24 |
| 4,974,967 | 12/1990 | Tsuyoshi et al. | 383/102 |

*Primary Examiner*—Stephen P. Garbe
*Attorney, Agent, or Firm*—Paul A. Fattibene; Arthur T. Fattibene

[57] ABSTRACT

A mesh shower bag having a reinforcing panel adjacent a zipper and a suction cup and clip. The mesh bag is easily transportable when used to carry wet or damp items to and from wet locations such as a shower. The bag can be attached by a suction cup in a shower and then by a clip for traveling or storage. Thereby, the bag can be conveniently used when traveling or making trips to the gym.

8 Claims, 2 Drawing Sheets

TRANSPORTABLE SHOWER BAG

FIELD OF THE INVENTION

The present invention relates generally to a bag used in wet locations or carrying wet articles, and more specifically to a shower bag that is easily transportable for temporary use at one location and moved to another.

BACKGROUND OF THE INVENTION

Numerous mesh bags have been developed for use in wet locations or to carry damp items. These bags have been created to carry such items as soap, laundry, and even food. One such bag is disclosed in U.S. Pat. No. 4,228,834 entitled "Soap Bag" and issuing to Desnick on Oct. 21, 1980. Therein disclosed is a plastic mesh bag having Velcro fasteners for closing and a loop segment for attachment to a strap. This bag is used as a scrubber and hand soap dispenser. Another bag having a mesh construction is disclosed in U.S. Pat. No. 4,388,739 entitled "Washing Bag for Curtains, Drapes, and the Like" issuing to Martinon et al on June 21, 1983. Therein disclosed is a bag for washing curtains having two spaced apart drawstrings adapted to define a compartment for holding hooks, rings or other attachments found on the items being washed. Yet another mesh bag is disclosed in U.S. Pat. No. 4,196,534 entitled "Plastic Bag and Label" issuing to Shibamato on Apr. 8, 1980. Therein disclosed is a net fabric bag formed from a thermoplastic resin monofilament yarn and a thermoplastic resin label that can be thermally adhered by melting to the body of the bag. While these mesh bags have proved adequate for their purpose, they are inconvenient in some applications. Therefore, there is a need for other mesh bags that can conveniently be used in different applications.

SUMMARY OF THE INVENTION

The present invention is directed to a transportable shower bag used when traveling or making trips to the gym. The bag can be used to carry toiletries such as soap, shampoo, toothbrush and toothpaste, shower cream, or other desired personal items that may be used in wet locations. The bag comprises a pouch made of plastic mesh having an open end. A panel is attached adjacent the open end. A zipper attached to the panel is used to close the bag. A tab extending from the panel holds a looped cord. Attached to the cord is a suction cup and a clip. The suction cup is used to attach the bag to a smooth, flat surface, such as a shower wall. The clip is used to attach the bag to a ring, strap, handle, or any other compatible device, and is especially used for attaching to a suitcase or gym bag when not placed in the shower. The shower bag of the present invention thereby permits easy transportability when traveling or making trips to and from the gym or other location when wet items may need to be easily transported.

Accordingly, it is an object of the present invention to provide a convenient shower bag for transporting and drying wet items including, but not limited to soap, shampoo, and conditioner containers.

It is another object of the present invention to provide a simple yet durable shower bag construction.

It is an advantage of the present invention that it is convenient to use.

It is another advantage of the present invention that it permits wet items to dry easily.

It is a feature of the present invention that multiple means for attachment, such as the clip and suction cup, are provided.

It is another feature of the present invention that a panel is placed adjacent the opening, providing additional strength.

DETAILED DESCRIPTION OF THE PREFERRED EMBODIMENT

Figure 1:
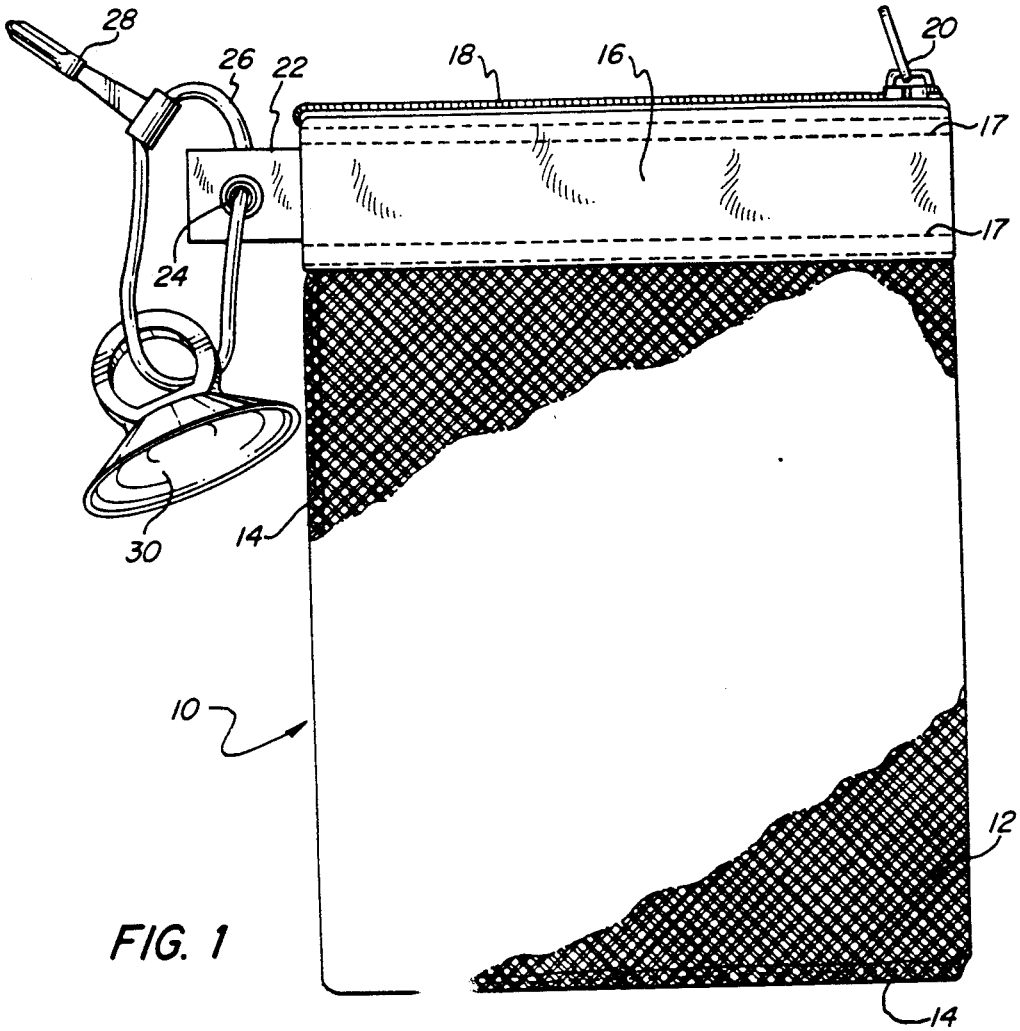
FIG. 1 is a front partial sectional view illustrating the present invention.

FIG. 1 generally illustrates the present invention. Shower bag 10 comprises a pouch 12 made of a mesh material. The mesh material can be made of any plastic, such as nylon. The pouch 12 is closed on two sides by seams 14. The pouch 12 can be made in any suitable size, such as approximately nine inches wide and twelve inches deep. Attached to the open end of pouch 12 is panel 16. Panel 16 is made of a nylon material having a tight weave. The weave is much tighter than that of mesh pouch 12. The panel 16 is attached to the pouch 12 by seams 17. The open end of panel 16 is closed by zipper 18. Zipper 18 has a zipper pull 20. The nylon panel 16 extends below the top opening of pouch 12 approximately two inches. Also attached to the panel 16 is tab 22. Tab 22 has a grommet 24 therein. Grommet 24 is preferably made of a non-corrosive material such as plastic or brass. Placed through grommet 24 is a rope or cord 26. Cord 26 is preferably made of a nylon material. Attached to the cord loop 26 is a clip 28 and a suction cup 30.

Figure 2:
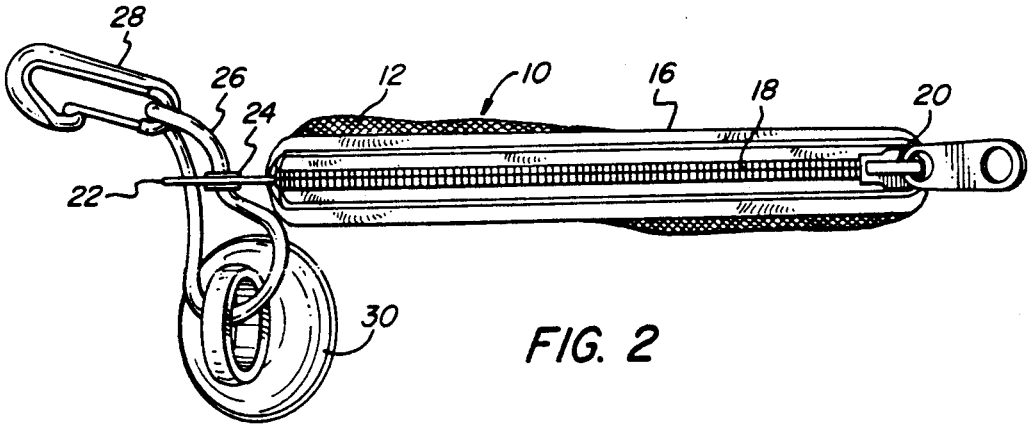
FIG. 2 is a top view illustrating the present invention.

In FIG. 2, the construction of the panel 16 can more clearly be seen. Panel 16 is a continuous strip of material that extends circumferentially around the top open end of pouch 12. In FIG. 2, it is also seen that the zipper 18 is in the closed position when the zipper pull 20 is furthest from tab 22. This facilitates easy opening and closing of the bag 10.

Referring to FIGS. 1 and 2, the operation of the device can readily be appreciated. Various toiletries can be inserted into the bag 10 through the opened zipper 18. Panel 16, positioned adjacent the open end, provides a solid durable section to grasp the bag 10. The mesh pouch 12, having an open, loose weave, is inherently weaker than the tighter, stronger panel 16. Therefore, the necessary grasping of the bag 10 for opening and closing the zipper 18 is less likely to damage or rip the mesh pouch 12.

Figure 3:
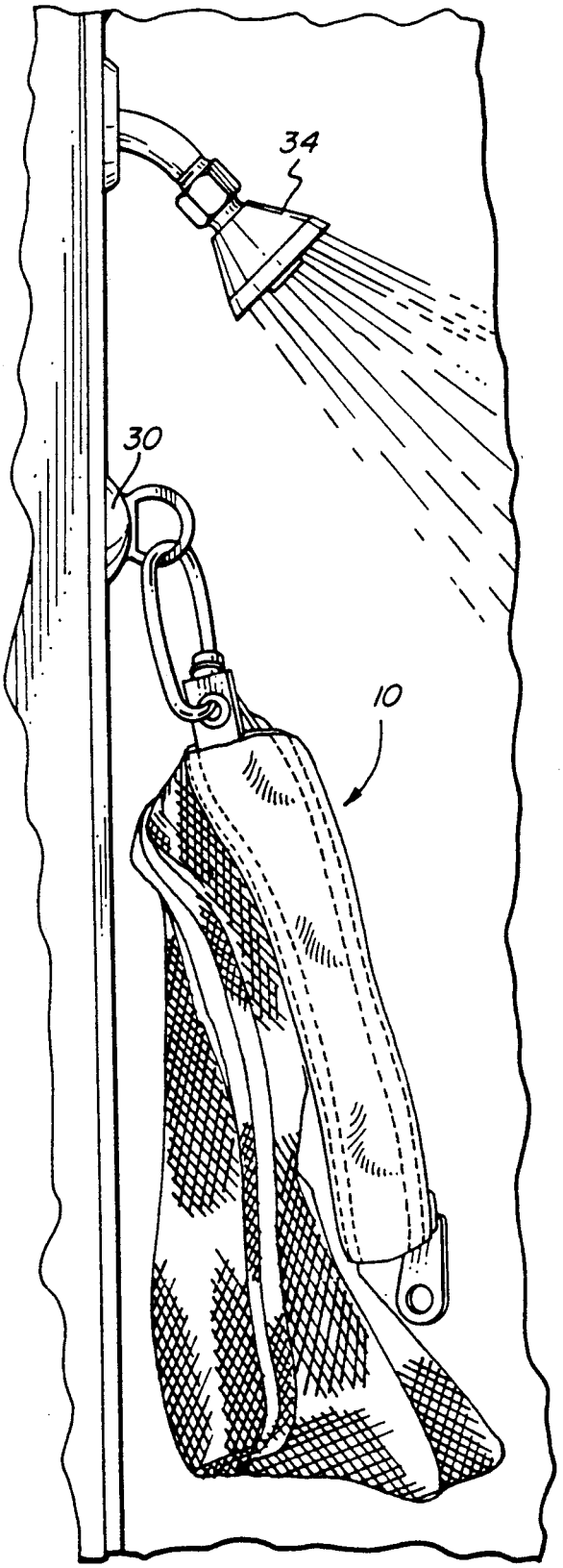
FIG. 3 illustrates one application of the present invention.
Figure 4:
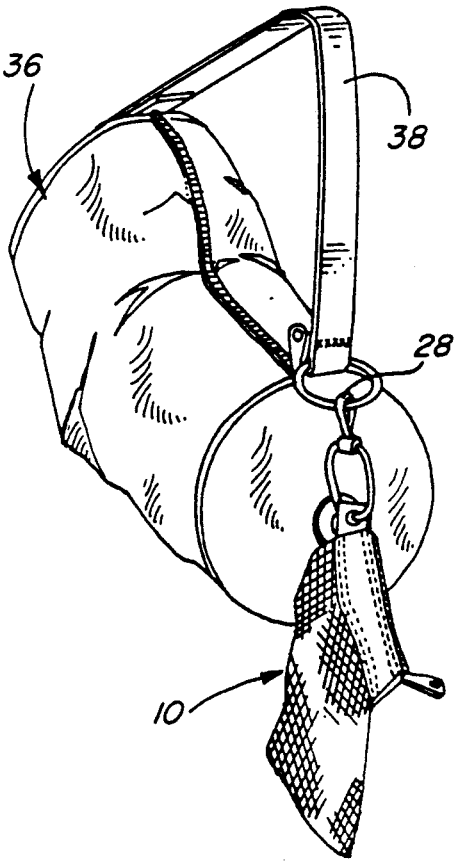
FIG. 4 illustrates another application of the present invention.

FIG. 3 and FIG. 4 illustrate the anticipated use of the present invention. In FIG. 3, bag 10 is illustrated in a shower 30. While in the shower and bathing with water from the shower head 34, bag 10 is fastened to the moist, smooth shower wall by suction cup 30. This is advantageous, in that personal hygiene items can be brought into public showers without having to rest the items on the floor or having to hold them during the entire bathing process. Upon leaving the shower 30, all of the items can conveniently be stored in the bag 10.

FIG. 4 illustrates the use of bag 10 after leaving the shower 30, illustrated in FIG. 3. Bag 10, now containing wet or damp items, can be attached by clip 28 to the handle 38 of a gym bag 36. This securely attaches bag 10, preventing loss while also permitting the wet or damp items contained therein to dry. Therefore, the present invention provides a convenience that heretofore was not available in any mesh bag.

Although the preferred embodiment has been illustrated and described, it will be obvious to those skilled in the art that various modifications may be made without departing from the spirit and scope of this invention.

What is claimed is:

1. A transportable bag for carrying articles to and from wet locations comprising:

a pouch made of plastic mesh having an open end;

a tightly woven plastic fabric panel attached to the open end of said pouch and extending down a portion of said pouch from the open end;

a zipper attached to said panel adjacent the open end;

a fabric tab attached to said fabric panel;

a cord looped through said fabric tab; and a suction cup attached to said cord.

2. A transportable bag as in claim 1, further comprising:

a clip attached to said cord.

3. A transportable bag as in claim 1, wherein:

said bag and panel are made of nylon.

4. A transportable bag as in claim 1, wherein:

said zipper is made of plastic.

5. A transportable bag as in claim 1, wherein:

said tab has a grommet therein.

6. A transportable bag as in claim 1, further comprising:

a zipper pull attached to said zipper;

said zipper being attached to said panel such that when said zipper is closed, said zipper pull is positioned at the end opposite the end having said tab attached.

7. A transportable bag for carrying articles to and from wet locations comprising:

a pouch made of plastic mesh having an open end;

a tightly woven plastic fabric panel attached to the open end of said pouch and extending down a portion of said pouch from the open end;

a zipper attached to said panel adjacent the open end;

a fabric tab attached to said fabric panel;

a cord looped through said fabric tab;

suction means, attached to said cord, for attaching the bag to a damp smooth surface; and clip means, attached to said cord, for attaching the bag in a dry area.

8. A transportable shower bag comprising:

a pouch made of yellow hexagonal nylon mesh having a seam on two sides and an open end, said pouch being approximately nine inches by twelve inches in size;

a tightly woven black nylon fabric panel extending approximately two inches toward the end opposite the open end, said panel having a double seam along both longitudinal ends;

a black nylon zipper attached to said open end and said panel;

a zipper pull attached to said zipper, said zipper attached to said panel so that when said zipper is closed said zipper pull is adjacent the unseamed side of said pouch;

a nylon tab attached to the seemed side of said pouch and panel;

a brass grommet attached to said tab;

an approximately six inch nylon cord tied in a loop through said grommet;

an approximately two inch rubber suction cup having a loop therein attached to said cord; and a plastic spring clip attached to said cord;

whereby the shower bag can be selectively secured to a shower wall with said suction cup, or a gym bag with said clip.

* * * * *